US005347971A

United States Patent [19]

Kobayashi et al.

[11] Patent Number: 5,347,971

[45] Date of Patent: Sep. 20, 1994

[54] APPARATUS FOR MONITORING AIR LEAKAGE INTO FUEL SUPPLY SYSTEM FOR INTERNAL COMBUSTION ENGINE

[75] Inventors: Yasunori Kobayashi; Tsuguo Sugiura, both of Anjo; Yoshiyuki Morita, Kariya, all of Japan

[73] Assignee: Nippondenso Co., Ltd., Kariya, Japan

[21] Appl. No.: 72,757

[22] Filed: Jun. 7, 1993

[30] Foreign Application Priority Data

Jun. 8, 1992 [JP] Japan ..... 4-147089

[51] Int. Cl.[5] ..... F02M 37/04

[52] U.S. Cl. ..... 123/520; 123/198 D

[58] Field of Search ..... 123/520, 521, 198 D, 123/518, 516, 519

[56] References Cited

U.S. PATENT DOCUMENTS

| | | | |
|---|---|---|---|
| 4,794,790 | 1/1989 | Margarit-Metaxa et al. . | |
| 5,105,789 | 4/1992 | Aramaki | 123/198 D |
| 5,143,035 | 9/1992 | Kayanuma | 123/198 D |
| 5,146,902 | 9/1992 | Cook | 123/520 |
| 5,158,054 | 10/1992 | Otsuka | 123/520 |
| 5,172,672 | 12/1992 | Harada | 123/198 D |
| 5,186,153 | 2/1993 | Steinbrenner | 123/519 |
| 5,193,512 | 3/1993 | Steinbrenner | 123/198 D |
| 5,205,263 | 4/1993 | Blumenstock | 123/518 |
| 5,245,973 | 9/1993 | Otsuka | 123/519 |

FOREIGN PATENT DOCUMENTS

| | | | |
|---|---|---|---|
| 0027865 | 2/1983 | Japan | 123/519 |
| 226754 | 2/1990 | Japan . | |
| 2102360 | 4/1990 | Japan . | |
| 2130255 | 5/1990 | Japan . | |
| 326862 | 2/1991 | Japan . | |

*Primary Examiner*—Carl S. Miller

*Attorney, Agent, or Firm*—Cushman, Darby & Cushman

[57] ABSTRACT

An apparatus for monitoring air leakage into a fuel supply system for an internal combustion engine is provided. This system comprises a pressure sensor for detecting a pressure level in a fuel supply passage of the fuel supply system which communicates between a fuel tank and an intake passage of the engine and providing a signal indicative thereof, an air leakage control valve for leaking ambient air into the fuel supply passage at a preselected rate, and an air leakage monitoring unit for detecting a first pressure in the fuel supply system when the air leakage control valve is closed to restrict the leakage of the ambient air and a second pressure when the air leakage control valve is open to leak the ambient air into the fuel supply passage, the air leakage monitoring unit providing an alarm signal indicating that there is a preselected amount of air leakage in the fuel supply system based on a difference between the first and second pressures.

8 Claims, 5 Drawing Sheets

APPARATUS FOR MONITORING AIR LEAKAGE INTO FUEL SUPPLY SYSTEM FOR INTERNAL COMBUSTION ENGINE

BACKGROUND OF THE INVENTION

1. Field of The Invention

The present invention relates generality to an apparatus for monitoring air leakage into a fuel supply system for an internal combustion engine. More particularly, the invention is directed to a purging operation failure detection system that operates so as detect a failure of an air-fuel mixture control system caused by variation in pressure in a fuel supply system resulting from air leakage thereinto.

2. Description of The Prior Art

Japanese Utility Model First Publication No. 2-26754 discloses a system which detects a negative pressure level in a purge passage communicating between a canister connected to a fuel tank and an intake passage of an engine, and determines that a failure in a purging operation (i.e., air leakage into a fuel supply system) occurs when the negative pressure level in the purge passage is lower than that in the intake passage.

In the prior art system, the pressure in the intake passage tends to vary greatly directly following a change engine speed. The variation in pressure in the purge passage due to the pressure variation in the intake passage is, however, delayed because of the large volume of the fuel tank, with the result being that the system mistakenly determines that a failure occurs in the purging operation.

For avoiding the above drawback, a system may be proposed which blocks fluid communication between the canister and an inlet port of the intake passage through the purge passage, and determines that a failure has occurred in the purging operation caused by an air leakage into a fuel supply system when a reduction rate of negative pressure in the fuel supply system exceeds a threshold level.

The above system, however, raises the following drawback, the volume of a line of the fuel supply system in which pressure is to be measured varies dependent upon the amount of fuel remaining in the fuel tank, a variation rate of the pressure in the fuel supply system may represent different values even if the amount of air leaking into the fuel supply system is constant. In order to avoid this drawback, the pressure variation rate may be compensated based on the amount of the remaining fuel detected by a fuel level sensor. It is, however, difficult to determine the volume of the fuel supply system in which pressure is measured because the fuel tank has a complex shape. Additionally, the fuel level sensor must be designed to have an explosion-proof construction, resulting in the total costs of the system being increased.

SUMMARY OF THE INVENTION

It is therefore a principal object of the present invention to avoid the disadvantages of the prior art.

It is another object of the invention to provide an apparatus which is able to accurately monitor the amount of air leaking into a fuel supply system of an internal combustion engine to detect a failure of an air-fuel mixture control system.

According to one aspect of the present invention, there is provided an apparatus for monitoring a degree of airtightness of a fuel supply system of an internal combustion engine which comprises a purge control valve which modifies a purge flow rate of fuel vapor from a fuel tank into an intake passage of the engine, an orifice means for allowing ambient air to be introduced into the fuel supply system at a preselected flow restriction, an air leakage control valve means arranged in series with the orifice means to selectively establish fluid communication through the orifice means, a pressure detecting means for detecting pressure in the fuel supply system to provide a signal indicative thereof, and an air leakage detecting means for determining a first pressure variation in the fuel supply system after the purge control valve is closed while the air leakage control valve means is closed and a second pressure variation in the fuel supply system after the purge control valve is closed while the air leakage control valve means is opened to allow the orifice to introduce the ambient air into the fuel supply system, the leakage detecting means determining a degree of airtightness of the fuel supply system based on a difference between the first and second pressure variations.

According to another aspect of the present invention, there is provided an air-fuel mixture control system for an internal combustion engine that is able to supply intake air from an air cleaner into the engine through an intake passage having disposed therein a throttle valve, store in a canister fuel vapors generated in a fuel tank, and supply the fuel vapors stored in the canister through a purge control valve into a portion of the intake passage downstream of the throttle valve, which comprises a pressure detecting means for detecting pressure in a fuel supply system having a line extending from the fuel tank to the canister and providing a signal indicative thereof, an orifice means, arranged between the air cleaner and the fuel supply system, for allowing air to into the fuel supply system at a preselected air leakage restriction, an air leakage passage having disposed therein an air leakage control valve which is operable to selectively allow and restrict the air leakage through the orifice means, and a failure detecting means responsive to the signal from the pressure detecting means for comparing a pressure variation in the fuel supply system while the air leakage control valve is closed after the purge control valve is closed with a pressure variation in the fuel supply system while the air leakage control valve is opened after the purge control valve is closed, to detect a failure of the fuel supply system.

According to a further aspect of the invention, there is provided an apparatus for monitoring an air leakage around a fuel supply system for an internal combustion engine which comprises a pressure sensor detecting a pressure level in a fuel supply passage of the fuel supply system which communicates between a fuel tank and an intake passage of the engine and provides a signal indicative thereof, a valve means for introducing ambient air into the fuel supply passage at a preselected rate, and an air leakage monitoring means for detecting a first pressure in the fuel supply system when the valve means is closed to restrict the introduction of the ambient air and a second pressure when the valve means is open to introduce the ambient air into the fuel supply passage, the air leakage monitoring means providing a signal indicating that there is a preselected amount of air leaking around the fuel supply system based on a difference between the first and second pressures.

BRIEF DESCRIPTION OF THE DRAWINGS

The present invention will be better understood from the following detailed description given hereinbelow and from the accompanying drawings of the preferred embodiments which are given for the purpose of explanation and understanding only and are not intended to limit the present invention.

In the drawings.

DESCRIPTION OF THE PREFERRED EMBODIMENT

Figure 1:
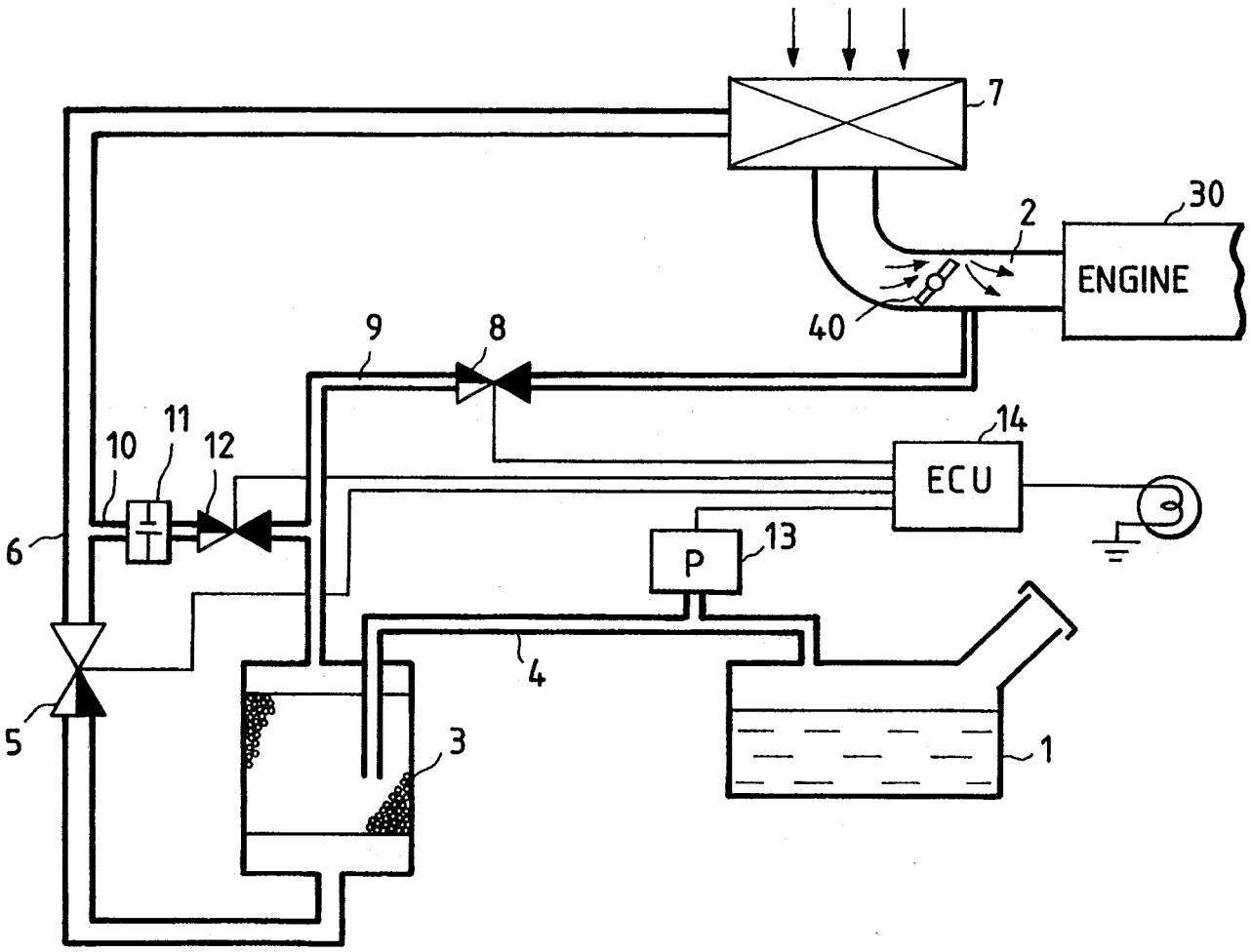
FIG. 1 is a block diagram which shows an apparatus which monitors air leakage into a fuel supply system for an internal combustion engine according to the present invention.
Figure 2:
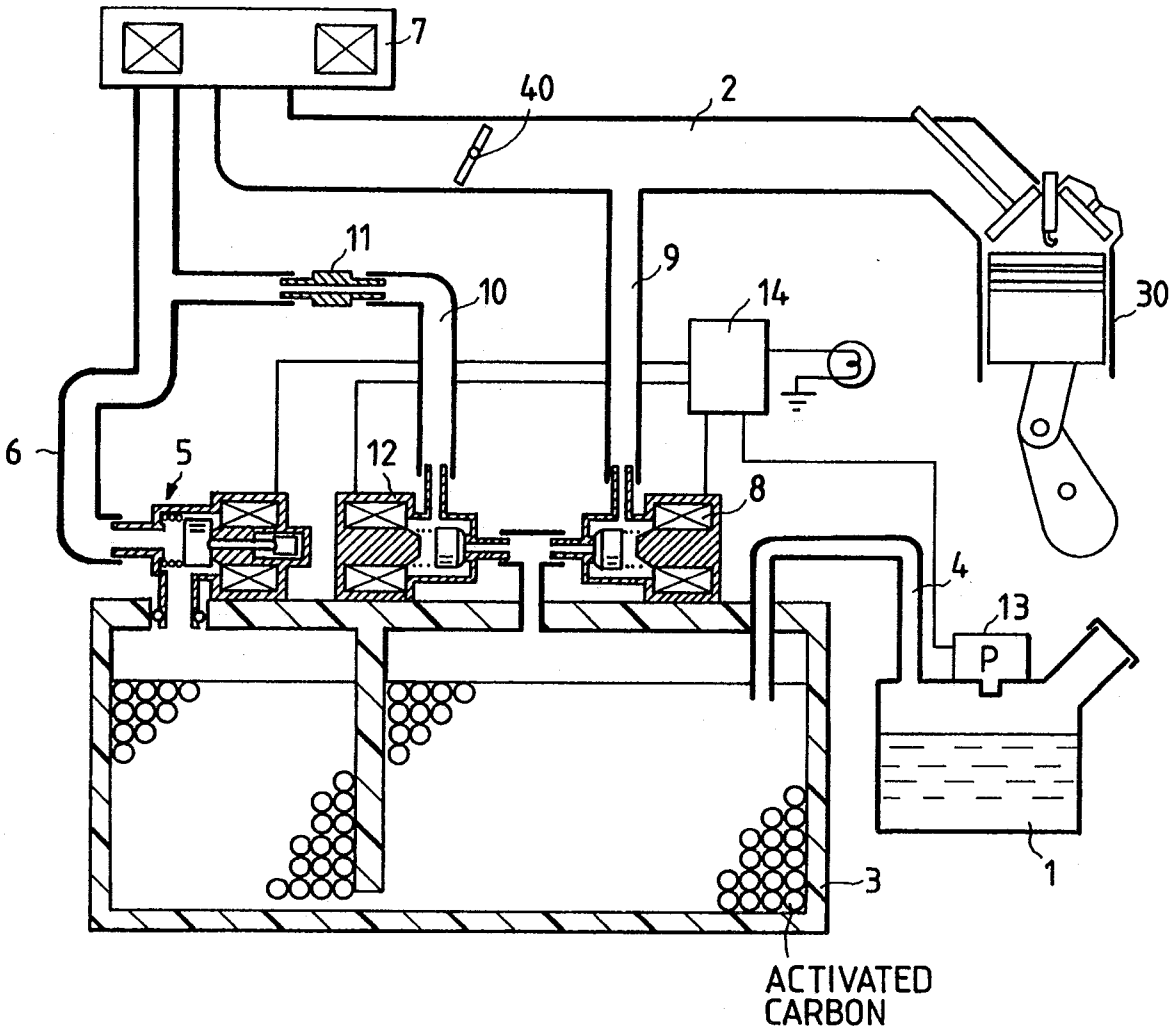
FIG. 2 is a cross-sectional view which shows an apparatus of the invention illustrated in FIG. 1.

Referring now to the drawings, particularly to FIGS. 1 and 2, there is shown an apparatus for monitoring air leakage (i.e., airtightness ) into a fuel supply system according to the present invention which may be employed in an air-fuel mixture control system for an automotive vehicle.

A fuel tank 1 is fluidly connected to fuel injectors (not shown) mounted in an intake manifold 2 of an internal combustion engine 30 through a fuel pump (not shown) and also connected to a fuel vapor storage canister 3 through a canister passage 4 to direct fuel vapors subsequently generated in the fuel tank 1 into the canister. The canister 3 includes a casing, which may be made of resin or metal, filled with an absorbing substance such as activated carbon serving to capture therein the fuel vapors generated in the fuel tank 1 before they can escape to the atmosphere. The canister 3 has an opening in its bottom surface which communicates with an air cleaner 7 (substantially exposed to atmospheric pressure) through a normally open type of solenoid operated valve 5 disposed in a purge air induction passage 6 and also communicates with a portion of the intake manifold 2 downstream of a throttle valve 40 through a purge passage 9 in which a normally closed type of solenoid operated purge control valve 8 which is adapted for modifying a rate of fuel vapor purged from the canister 3 into the intake manifold. As is well known, the throttle valve is operable to modify the amount of air drawn from the air cleaner 7 into the engine 30 through the intake manifold 2.

An air leakage passage 10 is arranged to communicate between a portion of the purge air induction passage 6 upstream of the solenoid operated valve 5 and a portion of the purge passage 9 upstream of the purge control valve 8. In the air leakage passage 10, an orifice 11 and an air leakage control valve 12 are arranged in series. The orifice 11 serves to provide a preselected flow restriction to ambient air being introduced through the air cleaner 7 into the air leakage passage 10. The air leakage control valve 12 is operable to selectively establish and block fluid communication through the air leakage passage 10. The air leakage control valve 12 and the orifice 11 may alternatively be provided with a one piece unit wherein an orifice having a preselected cross-sectional area is formed in an outlet port of a solenoid operated valve.

A pressure sensor 13 is arranged to detect a pressure level in the canister passage 4 and provides a signal indicative thereof to an engine control unit (ECU) 14.

Figure 3:
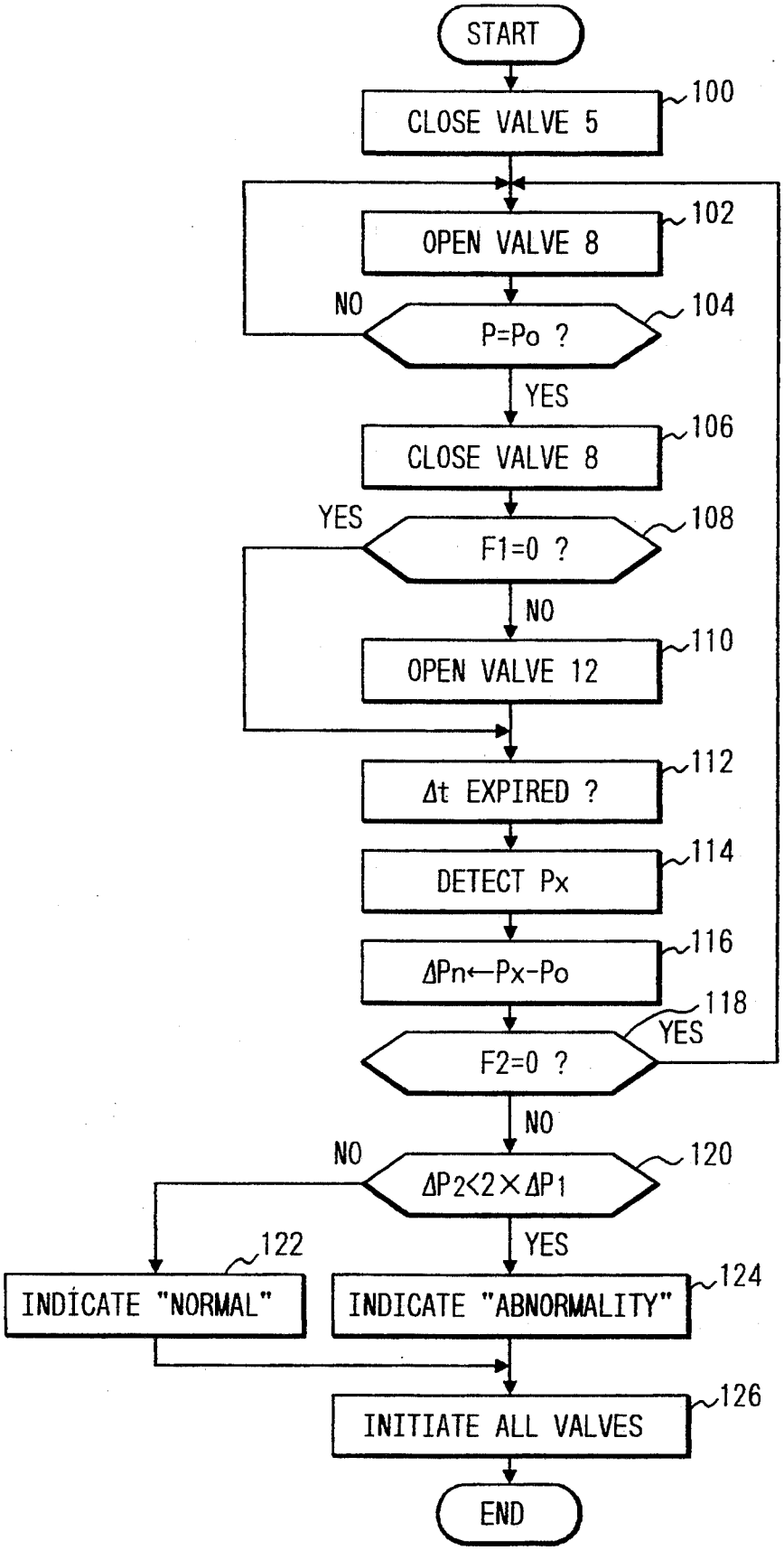
FIG. 3 is a flowchart which shows logical steps performed by a control unit of an apparatus shown in FIGS. 1 and 2.

Referring to FIG. 3, there is shown a flowchart of a program or sequence of the logical steps performed by the ECU 14.

After entering the program, the routine flows to step 100 wherein the ECU 14 provides a control signal to the solenoid operated valve 5 to close it completely. The routine then proceeds to step 102 wherein an average duty ratio of a control signal to the purge control valve 8 is increased gradually under the PWM (Pulse Width Modulation) control so that the purge control valve 8 is opened. This causes pressure P in a fuel supply system comprised of the fuel tank 1, the canister passage 4, and line enclosed by the valves 5, 12, and 8 to be reduced below the atmospheric pressure due to vacuum in the intake manifold 2. The routine then proceeds to step 104 wherein it is determined whether the pressure P in the fuel supply system is reduced to a preselected pressure level $P_o$ or not based on a sensor signal from the pressure sensor 13. If a NO answer is obtained, the routine returns back to step 102. Alternatively, if a YES answer is obtained, the routine then proceeds to step 105 wherein the purge control valve 8 is fully opened. The routine then proceeds to step 108 wherein it is determined whether a flag F1 indicates zero (0) or not. The flag F1 is set to zero upon initiation of this program. The determination in step 108 is made for determining whether the pressure measurement in step 104 is performed for the first time or not after the program is initiated. If a YES answer is obtained, the flag F1 is set to one (1), and the routine proceeds directly to step 112.

In step 112, the routine waits until a preselected period of time $\Delta At$ expires after the purge control valve 8 is fully closed. The routine then proceeds to step 114 wherein a negative pressure level $P_x$ in the canister passage 4 (i.e., in the fuel supply system) is monitored by means of the pressure sensor 13. The routine then proceeds to step 116 wherein an increase in pressure $\Delta P_1$ is determined according to the relation of $\Delta P_1 = P_x - P_o$. When the amount of air leaking into the fuel supply system is great, the pressure increase $\Delta P_1$ becomes high.

Afterwards, the routine proceeds to step 118 wherein determination is made as to whether a flag $F_2$ is zero or not. The flag $F_2$ is set to zero upon initiation of the program. It will be noted that the determination in step 118 is made for the purpose of determining whether the pressure measurement in step 114 is performed for the first time or not after the program is initiated. If a YES answer is obtained ($F_2=0$), the flag F2 is set to one (1), and the routine then returns to step 102 wherein the purge control valve 8 is maintained open fully. After repeating steps 104 and 106, it is determined in step 108 if the flag $F_1$ is zero. Since the flag $F_1$ has been, as already mentioned, set to one (1) in the previous cycle, a NO answer is obtained at this time in step 108. The routine thus proceeds to step 110 wherein the air leakage control valve 12 is opened to allow air drawn through the air cleaner 7 to leak into the purge passage 9 (i.e., into the fuel supply system) at a rate determined by activity of the orifice 11. Afterwards, in step 116, an increase in pressure $\Delta P_2$ due to the air leakage through the orifice 11 is determined according to the relation of $\Delta P_2 = P_x - P_o$.

After a NO answer is obtained in step 118, meaning that the flag F2 is one (1) the routine flows to step 120 wherein it is determined if the pressure increase $\Delta P_2$ is smaller than a preselected multiple of the pressure increase $\Delta P_1$ (e.g., a value twice the pressure increase $\Delta P_1$) determined when no air leaks through the orifice 11. When the pressure increase $\Delta P_2$ is equal to the pressure increase $\Delta P_1$, it represents that the amount of air leaking into the fuel supply system through the orifice 11 is equal to that leaking through portions other than the orifice. The orifice 11 is arranged to provide a preselected allowable flow restriction which establishes a constant amount of air leakage. Therefore, when the pressure increase $\Delta P_2$ does not exceed twice the pressure increase $\Delta P_1$, the routine proceeds to step 124 wherein an alarm is raised to inform s that a certain amount of air is leaking into the fuel supply system so that the pressure in the purge passage 9 is elevated relative to atmospheric pressure to cause intake passage vacuum required for purging fuel vapors stored in the canister 3 to be lowered. Alternatively, if a NO answer is obtained in step 120 concluding that the pressure increase $\Delta P_2$ exceeds twice the pressure increase $\Delta P_1$, the routine then proceeds to step 122 wherein a normal indicative signal is provided to inform that there is no air leakage affecting the purging operation.

After steps 122 or 124, the routine proceeds to step 126 wherein the valves 5, 8, and 12 are returned to their initial positions respectively, after which the routine terminates.

The relation between the variation in volume V is of the fuel supply system and the variation in internal pressure P due to air leakage will be discussed hereinbelow.

The internal pressure P of the fuel supply system may be expressed by the following equation: $P_o$denotes an initial pressure level, K denotes a constant of proportion defined by $d1^2/V$, and d denotes diameter of the orifice 11.

$$P = K^2(t - (P_o/K^2)^{0.5})^2$$

Differentiating P with respect to t, we obtain $$\frac{dP}{dt} = 2K^2(t - (P_o/K^2)^{0.5})$$

When t=0, we obtain $$\frac{dP}{dt} = -2KP_o^{0.5} = \alpha \times d1^2 P_o^{0.5}/V \quad (1)$$

Accordingly, from the above equation (1), a pressure variation A, when the air leakage control valve 12 is de-energized to close the orifice 11, may be given by the following equation.

$$A \propto d_x^2 P_o^{0.5}/V \quad (2)$$

where $d_x$ indicates a value corresponding to the amount of air leaking into the fuel supply system as represented as an orifice diameter.

Likewise, from the equation (1), a pressure variation B when the orifice 11 is open may be given by the following equation.

$$B \propto (d_x^2 + d1^2) P_o^{0.5}/V \quad (3)$$

Accordingly, the following relation may be obtained.

$$A/B = d_x^2/(d_x^2 + d1^2) \quad (4)$$

The orifice diameter $d_x$ corresponding to the amount of air leaking into the fuel supply system will be given by the following equation.

$$d_x = (A/(B-A))^{0.5} \times d1$$

As already mentioned, d1 represents the diameter of the orifice 11 which defines an allowable air leakage amount. It will be thus noted that the amount of air $d_x$ leaking into the fuel supply system is dependent upon a ratio of the pressure increase B to the pressure increase A (i.e., A/B). In this embodiment, $(A/(B-A))^{0.5}$ is set to 2, as shown in step 120, and based on the outcome of determination of whether or not B is smaller than a value which is twice A, it is easily determined if the amount of air leaking into the fuel supply system exceeds the allowable air leakage amount.

Figure 4:
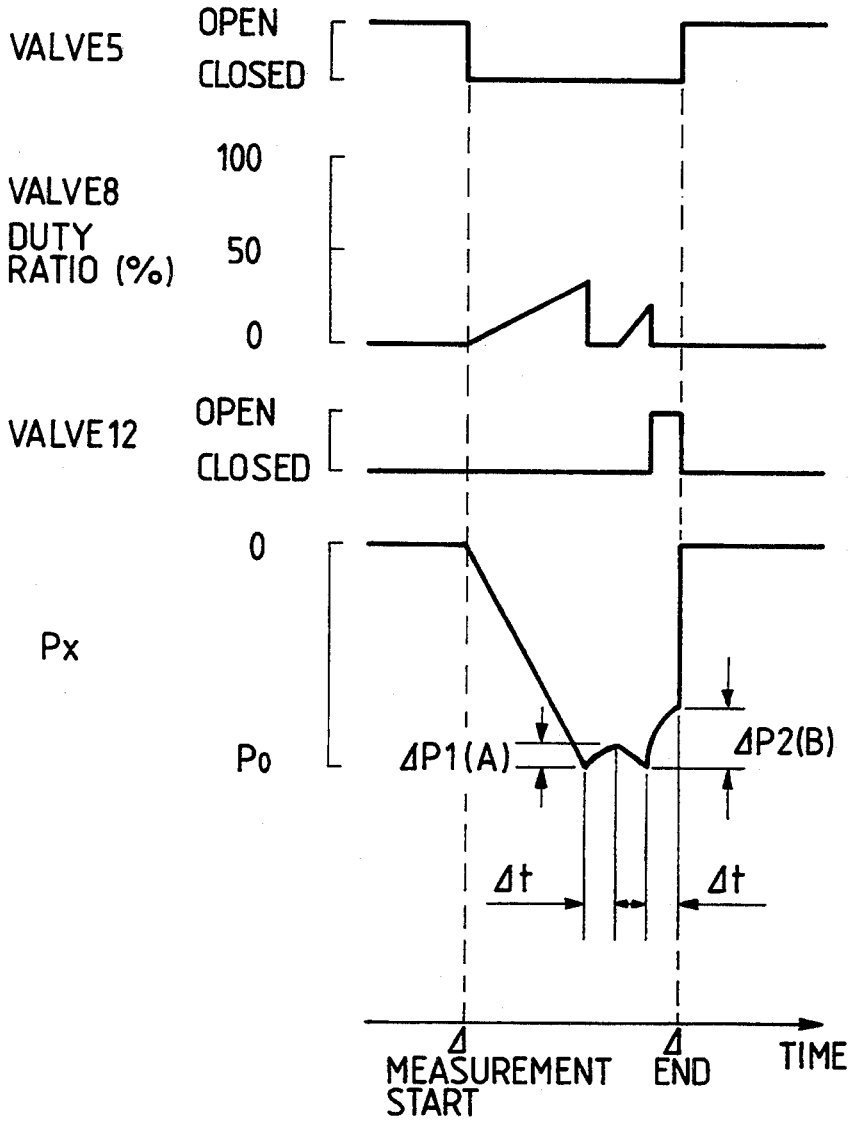
FIG. 4 is a time-chart which shows a relation between operations of solenoid operated valves and variation in pressure in fuel supply system.
Figure 5:
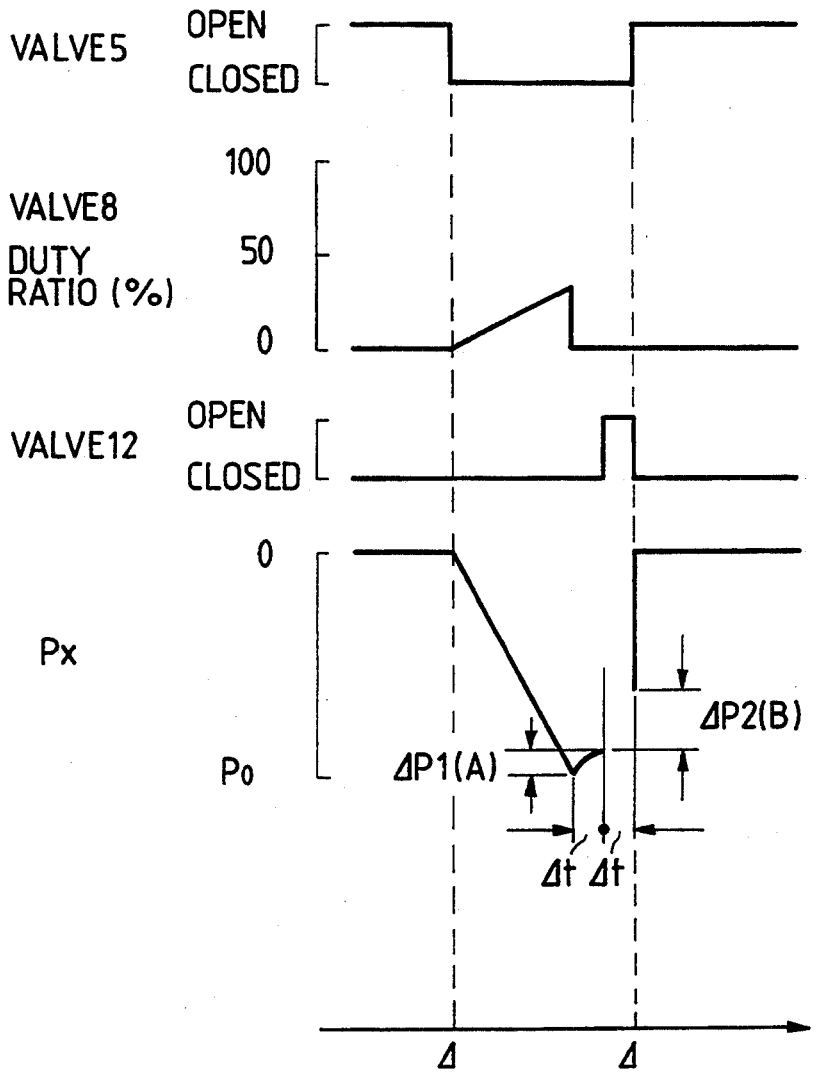
FIG. 5 is a time-chart which shows the operation of an alternative embodiment of the invention.

FIG. 4 shows a time-chart indicating operation of an alternative embodiment of the air leakage monitoring system according to the invention.

This second embodiment is such that in the flowchart as shown in FIG. 3, after reaching step 118 at the first time, the routine returns directly to step 110 without flowing back to step 102. With this sequence of steps, the air leakage monitoring time may be shortened.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims. For example, in the flowchart, as shown in FIG. 3, the first pressure detection may be made when the air leakage control valve 12 is opened while the second pressure detection may be made when the air leakage control valve is opened. Additionally, in the above embodiment, the pressure increase $\Delta Pn$ (i.e., pressure variation in the fuel supply system) is determined while both the solenoid operated valves 5 and 8 are fully closed. However, it is possible to determine the pressure variation while the solenoid operated valve 5 and 8 are slightly open although the pressure increase $\Delta Pn$ is further increased or decreased.

What is claimed is:

1. An apparatus for monitoring a degree of airtightness of a fuel supply system of an internal combustion engine comprising:

a purge control valve which modifies a purge flow rate of fuel vapor from a fuel tank into an intake passage of the engine;

orifice means for allowing ambient air to be introduced into the fuel supply system at a preselected flow restriction;

air leakage control valve means arranged in series with said orifice means to selectively establish fluid communication through said orifice means;

pressure detecting means for detecting pressure in the fuel supply system to provide a signal indicative thereof; and air leakage detecting means for determining a first pressure variation in the fuel supply system after said purge control valve is closed while the air leakage control valve means is closed and a second pressure variation in the fuel supply system after the purge control valve is closed while said air leakage control valve means is opened to allow the orifice to introduce the ambient air into the fuel supply system, said leakage detecting means determining a degree of airtightness of the fuel supply system based on a difference between the first and second pressure variations.

2. An air-fuel mixture control system for an internal combustion engine which is operable to supply intake air from an air cleaner into the engine through an intake passage disposing therein a throttle valve, store in a canister fuel vapors generated in a fuel tank, and supply the fuel vapors stored in the canister through a purge control valve into a portion of the intake passage downstream of the throttle valve, comprising:

pressure detecting means for detecting pressure in a fuel supply system having a line extending from the fuel tank to the canister and providing a signal indicative thereof;

orifice means, arranged between the air cleaner and the fuel supply system, for leaking air into the fuel supply system at a preselected air leakage restriction;

an air leakage passage disposing therein an air leakage control valve which is operable to selectively allow and restrict the air leakage through said orifice means; and a failure detecting means responsive to the signal from said pressure detecting means for comparing a pressure variation in the fuel supply system while said air leakage control valve is closed after the purge control valve is closed with a pressure variation in the fuel supply system while said air leakage control valve is opened after the purge control valve is closed, to detect a failure of the fuel supply system.

3. An air-fuel mixture control system as set forth in claim 2, wherein said canister has an opening exposed to atmospheric pressure, and further comprising a canister opening control valve which blocks communication through the opening of said canister when said failure detecting means detects the failure of the fuel supply system.

4. An air-fuel mixture control system as set forth in claim 3, wherein the opening of said canister is communicated with the air cleaner along with said air leakage passage.

5. An air-fuel mixture control system as set forth in claim 3, wherein said failure detecting means includes:

means for closing the canister opening control valve when detecting the failure of the fuel supply system;

means for opening tile purge control valve with the canister opening control valve being closed to introduce negative pressure created in the intake passage downstream of the throttle valve into the fuel supply system;

means for closing the purge control valve after detecting a condition where the negative pressure in the fuel supply system has become a preselected level;

means for opening the air leakage control valve with the purge control valve being closed after the negative pressure has become the preselected level;

means for detecting the variation in pressure detected by said pressure detecting means in a preselected period of time the air leakage control valve is closed with the purge control valve being closed after the negative pressure has become the preselected level;

means for detecting the variation in pressure detected by said pressure detecting means in a preselected period of time the air leakage control valve is open with the purge control valve being closed after the negative pressure has become the preselected level; and means for comparing the pressure variation when the air leakage control valve is closed with the pressure variation when the air leakage control valve is open to detect the failure of the fuel supply system.

6. An air-fuel mixture control system as set forth in claim 2, wherein the preselected air leakage restriction of said orifice means is set to a preselected allowable air leakage value, said failure detection means determines that the fuel supply system is malfunctioning when the pressure variation when the air leakage control valve is open is smaller than a value twice the pressure variation when the air leakage control valve is closed.

7. An apparatus for monitoring an air leakage around a fuel supply system for an internal combustion engine comprising:

a pressure sensor for detecting a pressure level in a fuel supply passage of the fuel supply system, which communicates between a fuel tank and an intake passage of the engine and provides a signal indicative thereof;

valve means adapted to be opened and closed for selectively introducing ambient air into the fuel supply passage and blocking the introduction of the ambient air into the fuel supply pages; and air leakage monitoring means, responsive to the signal from said pressure sensor, for determining a first pressure in the fuel supply system when said valve means is closed to restrict the introduction of the ambient air and a second pressure when said valve means is open to introduce the ambient air into the fuel supply passage, said air leakage monitoring means including pressure difference determining means for determining a difference between the first and second pressures and providing a signal indicating that there is a preselected amount of air leaking around the fuel supply system based on the difference between the first and second pressures.

8. An apparatus for monitoring an air leakage around a fuel supply system for an internal combustion engine comprising:

a pressure sensor that detects a pressure level in a fuel supply passage of the fuel supply system, the fuel supply passage communicating between a fuel tank and an intake passage of the engine and providing a signal indicative thereof;

valve means designed to be opened and closed fore selectively introducing ambient air into the fuel supply passage and blocking the introduction of the ambient air into the fuel supply passage; and air leaking monitoring means, responsive to the signal from said pressure sensor, for detecting a first pressure variation in the fuel supply passage after communication is blocked between the fuel supply passage and the intake passage of the engine and a second pressure variation in the fuel supply passage after said valve means is opened to introduce the ambient air into the fuel supply passage while communication between the fuel supply passage and the intake passage is blocked, said air leakage monitoring means including a pressure variation determining means for determining a difference between the first and second pressure variations to determine that a failure occurs in the fuel supply when the difference between the first and second pressure variations is lower than a preselected value.

* * * * *